United States Patent [19]

Bush et al.

[11] 4,132,609

[45] Jan. 2, 1979

[54] METHOD OF AND APPARATUS FOR ELECTROLYTIC TREATMENT OF METAL

[75] Inventors: Glenn W. Bush, Coraopolis, Pa.; Lowell W. Austin, Weirton, W. Va.

[73] Assignee: National Steel Corporation, Pittsburgh, Pa.

[21] Appl. No.: 822,672

[22] Filed: Aug. 8, 1977

[51] Int. Cl.[2] ..... C25D 7/06; C25D 7/10

[52] U.S. Cl. ..... 204/28; 204/206; 204/211

[58] Field of Search ..... 204/28, 268, 206–211

[56] References Cited

U.S. PATENT DOCUMENTS

| | | | |
|---|---|---|---|
| 2,265,645 | 12/1941 | Johnson et al. | 204/257 |
| 2,556,017 | 6/1951 | Vonada | 204/141 |
| 3,804,739 | 4/1974 | Bergeron | 204/266 |
| 3,901,771 | 8/1975 | Froman et al. | 204/28 |
| 3,945,892 | 3/1976 | James et al. | 204/1 R |
| 3,959,099 | 5/1976 | Froman et al. | 204/146 |
| 3,988,216 | 10/1976 | Austin et al. | 204/28 |

*Primary Examiner*—John H. Mack
*Assistant Examiner*—William T. Leader
*Attorney, Agent, or Firm*—Shanley, O'Neil & Baker

[57] ABSTRACT

An electrolytic process and a cathode structure for use in the process for treatment of an elongated strip of metal as the strip is passed between an anode immersed in an acidic anolyte solution and a cathode immersed in a basic catholyte solution separated from the anolyte solution by an ion-permeable membrane. The cathode structure includes means for directing a flow of the catholyte solution through a chamber enclosing a negatively-charged cathode plate to cool the structure and to remove hydrogen gas which is evolved on the active cathode surface to increase the efficiency of the electrolytic process.

26 Claims, 5 Drawing Figures

FIG. 3
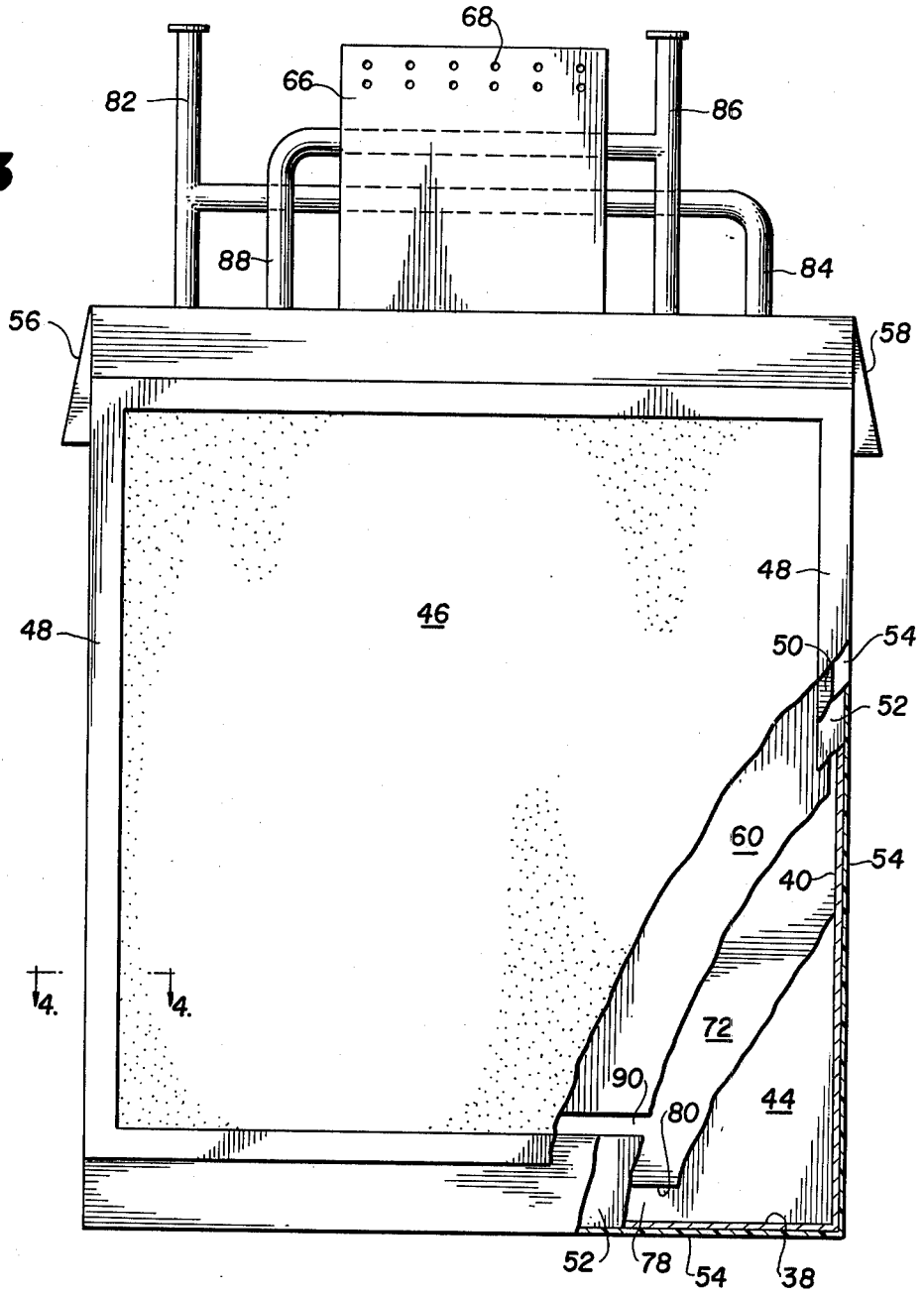
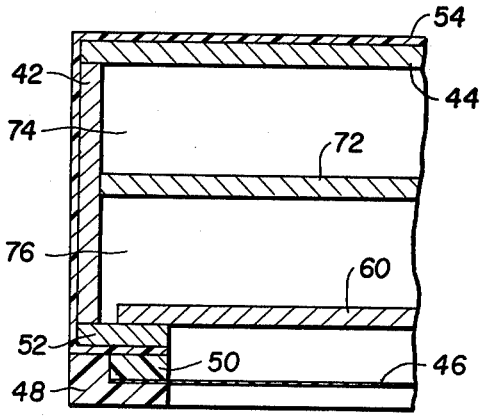
FIG. 4

METHOD OF AND APPARATUS FOR ELECTROLYTIC TREATMENT OF METAL

BACKGROUND OF THE INVENTION

1. Field of the Invention

This invention relates to an electrolytic process for the treatment of strip metal, and more particularly to an improved cathode structure for use in an electrolytic process in which the positively-charged anode and negatively-charged cathode are separated by an ion-permeable membrane.

2. Description of the Prior Art

Electrochemical or electrolytic processes for the continuous treatment of a running length of strip metal, and apparatus for the performance of such processes, are known in which anode and cathode means are immersed in anolyte and catholyte solutions, respectively, with the solutions being confined to contiguous chambers separated by an ion-permeable wall or membrane. A method of producing galvanized sheet metal having a zinc coating on one side only is disclosed in U.S. Pat. No. 3,988,,216, assigned to the assignee of the present invention. According to this prior art patent, a strip of metal which has been previously coated on both sides is drawn through a first electrolyte solution between an anode immersed in the bath and a cathode immersed in a second electrolyte solution which is kept separated from the first solution by a perm-selective anion membrane. By applying negative current to the cathode and positive current to the anode, zinc is removed from the side of the strip facing the cathode and a substantially equal amount of zinc is simultaneously plated onto the side facing the anode.

Electrolytic treatment apparatus is also known in which anolyte and catholyte solutions are continuously flowed through adjacent chambers separated by an ion-permeable membrane during operation, one such apparatus being shown, for example, in U.S. Pat. No. 3,945,892.

In the production of galvanized strip steel, relatively high current densities are required in order to plate the strip at a commercially acceptable rate. Such strip may be up to six feet, or more, in width. This width, combined with the high speed of the strip through the apparatus, requires the use of relatively large anode and cathode surface areas and high current densities in order to effectively plate the strip. The high current densities and large electrode areas result in the generation of substantial amounts of heat which tends to heat the electrolyte solutions in which the anode and cathode are immersed.

Ion-permeable membranes for use in electrolytic processes are commercially available and conventionally are formed materials such as thermoplastic synthetic resin materials which are heat-sensitive and very delicate when formed into a thin sheet or membrane. The heat which can build up in the electrolyte solutions during the high speed electrolytic treatment of strip metal has in the past caused serious problems in the use of the heat sensitive ion-permeable membranes in such apparatus.

In the one-side galvanized process of U.S. Pat. No. 3,988,216, the anode is immersed in an acidic electrolyte solution, or anolyte, and the cathode in a basic electrolyte solution, or catholyte. When the strip is passed between the anode and cathode, zinc coating on the side of the strip adjacent the cathode is oxidized to zinc ions which go into solution, while a substantially equivalent amount of zinc ions are reduced to zinc metal and deposited from the solution on the side of the strip facing the anode. Water disassociates at the anode and the cathode, with hydroxyl ions and hydrogen gas being generated at the cathode and hydrogen ions and oxygen gas being generated at the anode. The hydroxyl ions carry the electrical current through the ion-permeable membrane where they reunite with the hydrogen ions to re-form water. However, the hydrogen gas generated at the surface of the cathode tends to interfere with the electrolytic action of the apparatus, particularly when the gas is permitted to accumulate and form bubbles on the surface of the cathode.

It is, therefore, the primary object of the present invention to provide an improved electrolytic process for use in the continuous treatment of strip metal, and to provide an improved cathode structure for use in such electrolytic process.

It is a further object of the present invention to provide an improved cathode structure for use in an electrolytic process in which the anode and cathode are immersed in separate electrolytic solutions separated by an ion-permeable membrane.

Another object of the invention is to provide such an improved cathode structure for use in the production of one-side galvanized sheet or strip material and having improved means for cooling the cathode and removing hydrogen gas from the surface of the cathode.

Another object of the invention is to provide an improved cathode structure having means for circulating the anolyte solution over the surface of the cathode at a rate sufficient to effectively flush hydrogen gas from the cathode surface and to cool the surface and the adjacent ion-permeable membrane.

SUMMARY OF THE INVENTION

In attainment of the foregoing and other objects and advantages, an important feature of the invention resides in providing a cathode structure in which the cathode in the form of a plate is enclosed in a fluid-tight container which is adapted to be submersed in the anolyte solution, with a surface of the container extending adjacent to a surface of the cathode being constructed of an ion-permeable membrane. Means are provided for flowing the catholyte solution through the container over substantially the full extent of the cathode surface and over the inner surface of the ion-permeable membrane to simultaneously cool the cathode and the membrane and to flush hydrogen gas from the surface of the cathode during operation of the apparatus. Preferably, the cathode is arranged in the apparatus with the cathode plate in a substantially vertical attitude, and the catholyte solution is directed upwardly over the cathode surface to more effectively remove the hydrogen bubbles.

BRIEF DESCRIPTION OF THE DRAWINGS

The foregoing and other features and advantages of the invention will become more apparent from the detailed description contained herein, taken in conjunction with the drawings, in which:

FIG. 3 is a front elevation view of the cathode structure of FIG. 2, with parts broken away to more clearly show other parts;

FIG. 4 is a fragmentary sectional view taken on line 4—4 of FIG. 3; and

DESCRIPTION OF THE PREFERRED EMBODIMENTS

Figure 5:
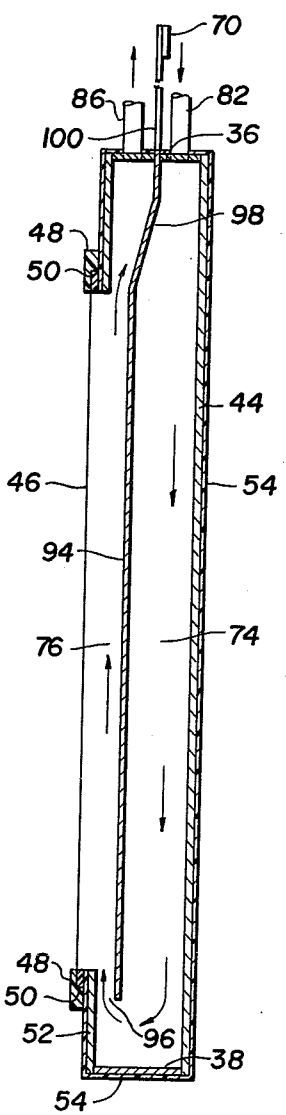
FIG. 5 is a view similar to FIG. 2 and showing an alternate embodiment of the cathode structure.

Referring now to the drawings in detail, an electroplating apparatus especially adapted for treating strip steel is indicated generally by the reference numeral 10 and includes an electrolyte tank 12 defined by a bottom wall 14, opposed end walls 16, 18, and opposed side walls only one of which is shown at 19. A removable top cover 20 may be positioned over the top of tank 12 where necessary. The strip 22 to be processed or treated passes over the top of the end wall 14 and is guided in a fixed path through an electrolyte solution in the tank 12 by guide rolls 24, 26, 28 and 30. Rolls 24 and 30 are mounted adjacent the top of the tank, near the end walls 14 and 16, respectively, while rolls 26 and 28 are mounted adjacent the bottom wall of the tank. Bottom rolls 26, 28 can be replaced with a single roll provided it is of sufficient diameter to permit two cathode structures or assemblies 32 to be positioned between the vertical passes of the strip within the electrolyte solution in tank 12. A pair of flat plate anodes 34 are positioned in spaced, opposed relation one to each of the cathode assemblies on the side of the strip opposite the cathode assemblies.

Figure 2:
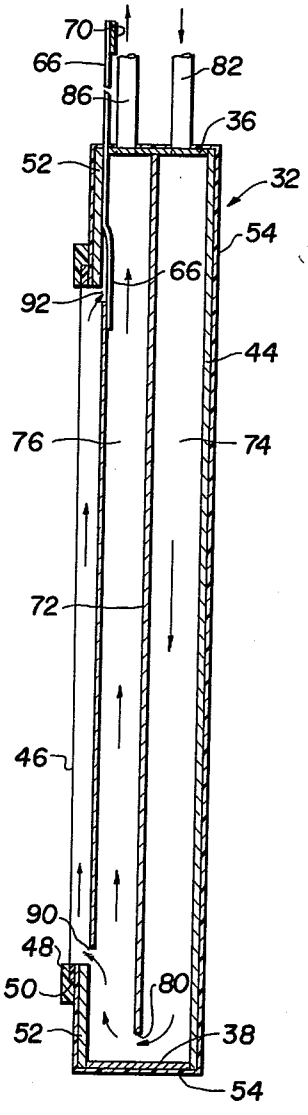
FIG. 2 is an enlarged side elevation view, in section, of a cathode structure according to the invention.
Figure 1:
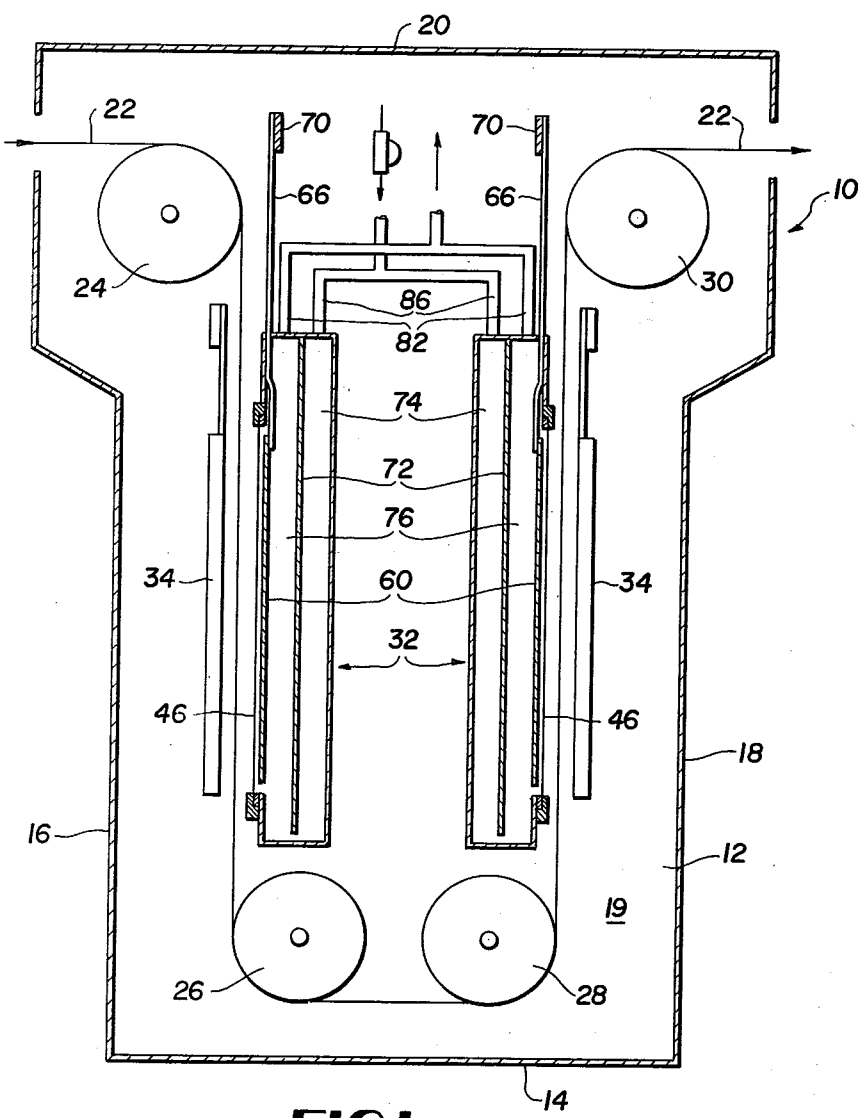
FIG. 1 is a side elevation view, in section, of an electroplating apparatus for treating strip metal employing a cathode structure according to the present invention.

The cathode assembly or structure shown in FIGS. 2 through 4 is similar in function to that shown in FIG. 5, with the two embodiments differing only in minor structural details. In describing the embodiments, like reference numerals will be applied to like parts and the two embodiments will be referred to as the same except when describing the specific differences. Thus, with specific reference to FIGS. 2 through 4, the cathode assemblies 32 each comprise a relatively thin, rectangular, box-like fluid container having opposed end edge walls 36, 38 and opposed side edge walls 40, 42 rigidly joined at the corners of the assembly. A flat back wall panel 44 is joined in fluid-tight relation to the end and side edge walls.

The front wall of the receptacle includes an ion-permeable membrane 46 supported around its peripheral edge portions by an open rectangular frame assembly including outer and inner frame members 48, 50, respectively, each preferably made from a rigid synthetic resin or similar material unaffected by the acidic electrolyte solution in tank 12. The membrane 46 is supported by an inwardly-directed flange 52 mounted in fluid-tight relation on the edge portions of side walls 36, 38, 40, and 42 to form a fluid-tight enclosure.

The external surface of the enclosure, including the flange 52, the end and side edge walls 36, 38, 40 and 42, and the rear panel 44 can be covered or coated with a layer 54 of rubber-like dielectric material which is unaffected by the acid electrolyte solution in tank 12. Suitable support brackets indicated at 56, 58 can be provided on the outer surface of the side edge walls 40, 42, respectively, for supporting the cathode assembly on cooperating support brackets, not shown, within the tank 12.

A cathode plate 60, which may be a flat, rectangular steel plate, mounted within the fluid container, extends in parallel spaced relation to the membrane 46. Cathode plate 60 has its side edges rigidly joined to the portions of flange 52 which extends adjacent side edge walls 40, 42 by suitable means, such as welding. The top and bottom edges of plate 60 are spaced from the top and bottom portions of flange 52, i.e., the portions of the flange extending adjacent end edge walls 36, 38, respectively.

The cathode plate 60 is rigidly joined, as by welding, along its top edge, i.e., the edge extending in spaced relation to wall 36, to an electrically-conductive metal plate 66 which extends between the flange 52 and wall 36 to the exterior of the container. Plate 66 is provided with a plurality of openings 68, for connection to a suitable bus-bar 70 to supply negative electric current to the cathode plate 60.

An internal divider wall 72 is mounted within the interior of the box-like container, with the divider wall extending between the side walls 40, 42 from the end wall 36 to a position adjacent the end wall 38 to divide the interior of the container into front and back compartments or fluid chambers 74, 76, which are connected by a narrow channel 78 defined by the wall 38 and the adjacent edge 80 of divider wall 72. In operation of the apparatus, a basic catholyte solution such as an aqueous solution of sodium hydroxide is supplied to the interior of compartment 74 by an inlet pipe 82 mounted in the end wall 36. Pipe 82 preferably has a T-connection which supplies catholyte solution to a branch line 84 also connected to the compartment 74, with the pipes 82 and 84 supplying the catholyte solution at points near the opposed sides of the compartment. Catholyte solution under pressure, supplied from a suitable source as by a pump, not shown, flowing into the compartment 74 flows through the compartment and through the connecting channel 78 to and through the compartment 76 to exit through outlet pipes 86, 88 which are joined by a suitable T-fitting. A suitable flange coupling is provided on outlet pipe 86 for connecting to a suitable conduit, not shown, to return the catholyte solution to a reservoir. A similar flange coupling can be provided in inlet pipe 82.

Catholyte solution flowing through compartment 76 has to flow across the full vertical dimension of the compartment, i.e., from the end wall members 38 to the outlet at wall member 36. A portion of the catholyte solution flowing through compartment 76 will flow through the space 90 between the bottom edge of cathode plate 60 and the adjacent portion of flange 52, then along the space between the plate 60 and the ion-permeable membrane 46 and out through the space 92 at the top edge of plate 60. Thus, the catholyte solution flows along both surfaces of the cathode plate, cooling the plate and tending to remove hydrogen gas bubbles which are generated at the surface of the cathode during operation of the apparatus. The apertures in the cathode plate tend to create a slight turbulence which aids in the gas bubble removal.

The continuous flow of the catholyte solution through compartment 76 cools the temperature-sensitive ion-permeable membrane 46 to avoid temperature damage. Providing a plurality of fluid inlets and fluid outlets along the top edge wall of the cathode chamber assures a more uniform flow through the assembly to thereby assure adequate cooling and substantially complete removal of hydrogen gas bubbles from the surface of the cathode. This uniform flow is also assured by the relatively narrow channel 78 which serves to distribute the fluid flowing through the rear compartment 74 substantially uniformly across the front compartment 76.

In the embodiment of the cathode structure shown in FIG. 5, the divider wall has been eliminated and the cathode plate employed to divide the interior of the container into rear and front compartments 74, 76. The cathode plate 94 is joined, as by welding, to the side edge walls and extends from the end edge wall 36 and terminates in a free edge 96 extending in spaced relation to flange 52 adjacent wall 38. Cathode plate 94 extends in parallel relation to membrane 46 throughout substantially the entire extent of the membrane. Plate 94 can have an offset portion 98 which extends through wall 36 to form a connector plate 100 for connection to the bus-bar 70 for supplying electrical energy to the cathode plate.

The operation of the embodiment of FIG. 5 is substantially the same as for the previously-described embodiment. Thus, catholyte solution entering the container flows from the top of the container downward through rear compartment 74, then up through front compartment 76 over the membrane 46 and the adjacent parallel surface of the cathode plate and out through outlet pipe 86. However, in this embodiment, the cathode plate 94, which acts as the divider wall, is in contact with the catholyte solution throughout its flow path from the inlet through compartment 74, around edge 96 and up through compartment 76 to the outlet. Since all the catholyte solution must flow between the membrane and the cathode plate, the spacing between these members may be somewhat greater than in the earlier-described embodiment.

Ion-exchange membranes are commercially available which are perm-selective, i.e., which permit only negative or positive ions to pass. By employing a membrane which will permit only the passage of negative ions, called an anion membrane, in the cathode structure, the hydroxyl ions generated at the cathode pass through the membrane to carry the electric current and unite with the hydrogen ions in the anolyte solution. An anion membrane which has been found especially wel-ladapted to the present invention is manufactured by Ionac Chemical of Birmingham, New Jersey and identified as their membrane MA-3475. This material in sheet form having a thickness of approximately 15 mils can be employed with current densities on the electrodes of as high as 1000 amps per square foot when electrolyte solutions of sufficient concentration to transport current at reasonable efficiencies are employed and provided the temperature build-up in the solution is controlled. The membrane is formed from a thermoplastic material, making it necessary to control the heat to avoid excessive reduction of strength of the relatively thin, delicate membrane.

The cathode assembly according to the present invention enables the cathode plate to be immersed in a relatively small volume of catholyte solution, with the container for the solution and plate being sufficiently small to enable one of the cathode structures 32 to be positioned within the anolyte tank 12 adjacent each vertical pass of the strip 22 through the treatment apparatus 10. By flowing the catholyte solution across the entire surface of the cathode plate, hydrogen gas is effectively removed to thereby enhance the electrical efficiency of the apparatus. At the same time, the continuous flow of catholyte solution through the relatively thin, box-like chamber assures continuous cooling of the membrane. The heat absorbed by the catholyte solution can be removed in a reservoir outside the apparatus where space is not at a premium.

The thin, flat construction of the catholyte compartment 76 enables the positioning of the cathode in the desired position relative to the strip 22 passing through the apparatus without requiring an excessively large anolyte tank. Continuous and efficient cooling of the cathode and membrane, made possible by the catholyte chamber design, reduces the pressure required to provide the necessary flow through the assembly. By maintaining the pressure differential across the membrane 46 at a minimum, deflection of the membrane is reduced, thereby avoiding contact with the moving strip, which is maintained under tension, during operation of the apparatus.

The cathode assembly is illustrated in the drawings as being employed with the cathode plate in a vertical plane and the catholyte solution being admitted and removed at the top edge of the thin, box-like chamber. While this arrangement provides the most efficient gas removal from the surface of the cathode, and makes handling of the cathode assembly more convenient, the invention is not limited to this arrangement. For example, the cathodes could be employed in an inclined or horizontal position. Also, any number of the cathodes may be employed, as required, for the efficient and effective plating of the strip at a commercially acceptable rate.

It is also believed apparent that modifications in the structural configuration of the cathode compartment, and of the cathode plate, per se, may be made within the scope of the invention. For example, the cathode plate may be formed from a metal plate having a plurality of openings formed therein, or be formed from an expanded metal sheet having a regular pattern of openings therein, so that the cathode plate can extend over the entire opening defined by the supporting flange 52, with the catholyte solution flowing through the openings and along the membrane 46 in its path through the compartment 76.

Accordingly, while we have disclosed and described preferred embodiments of our invention, we wish it understood that we do not intend to be restricted solely thereto, but rather that we do intend to include all embodiments thereof which would be apparent to one skilled in the art and which come within the spirit and scope of our invention.

We claim:

1. In a system for electrolytic treatment of an elongated metal member in which the member is drawn through a first electrolyte solution in a container between opposed surfaces of a positively-charged anode and a negatively-charged cathode submerged in the first electrolyte solution, the method comprising the steps of enclosing the cathode within a fluid-tight chamber submerged within the first electrolyte solution, the chamber having one wall defined by an ion-permeable membrane extending between the metal member and the cathode and in closely spaced generally parallel relation to the cathode surface, and flowing a second electrolyte solution through the chamber so that at least a portion of the solution flows between the membrane and the adjacent cathode surface to cool the membrane and cathode and remove gas evolved on the surface of the cathode.

2. The invention as defined in claim 1 wherein the anode and cathode are substantially flat and generally rectangular in shape and supported in generally vertical planes, and wherein the step of flowing the second electrolyte solution through the fluid-tight chamber includes initially flowing the second electrolyte solution downwardly through a first compartment in the chamber to the bottom thereof, then upwardly through a second compartment containing the cathode, and withdrawing the second electrolyte solution from the second compartment at a position adjacent the top of the chamber.

3. The invention as defined in claim 1 including the steps of drawing the elongated metal member through the first electrolyte solution in a plurality of substantially vertical passes each extending between a separate anode and cathode submerged in the first electrolyte solution, enclosing each of the cathodes within a separate fluid-tight chamber submerged within the first electrolyte solution, the chambers each having one wall defined by an anion membrane extending between the metal member and the cathode and in closely spaced relation to the cathode surface, and flowing a second electrolyte solution through each chamber so that at least a portion of the second catholyte solution flows between the membrane and the adjacent cathode surface to cool the membrane and cathode and to remove gas evolved on the surface of the cathode.

4. Apparatus for electrolytically treating metal in elongated strip form comprising means for drawing the strip through a bath of a first electrolyte solution between a flat, generally rectangular, positively-charged anode supported within the bath and a flat, generally rectangular, negatively-charged cathode, the apparatus further comprising, in combination, a generally rectangular fluid-tight chamber enclosing the cathode, the fluid-tight chamber having a front wall including an anion membrane extending in closely-spaced relation to and overlying one flat surface of the cathode between the cathode and the anode, and a back wall extending in generally parallel relation to the membrane in spaced relation to and overlying the flat surface of the cathode opposite the membrane, mounting means supporting the fluid-tight chamber and the cathode in the bath with the anion membrane and the one flat surface of the cathode extending in opposed, generally parallel spaced relation to one flat surface on the anode, fluid inlet means for admitting a flow of a second electrolyte solution into the chamber, fluid outlet means for permitting the discharge of the second electrolyte solution from the chamber, the fluid outlet means being located adjacent one edge of the cathode, and means directing the second electrolyte solution flowing through the chamber from the inlet to the outlet to cause the second electrolyte solution to flow over substantially the entire flat surfaces of the cathode with at least a portion of the solution flowing between the anion membrane and the cathode.

5. The apparatus as defined in claim 4 wherein the chamber further comprises generally parallel spaced end edge walls and generally parallel spaced side edge walls joined at the corners of the chamber and supporting the front and back walls to form a closed box-like chamber containing the cathode, the width of the end and side edge walls measured between the front and back walls being small in relation to their length to reduce the volume of the chamber while assuring maximum contact of the second catholyte solution flowing therethrough with the cathode and the membrane.

6. The apparatus as defined in claim 5 further comprising a partition wall mounted within the box-like chamber between the cathode and the back-wall and extending generally parallel thereto between the side edge walls from one end edge wall and terminating in a free edge disposed adjacent the other end edge wall, the partition wall dividing the box-like chamber into thin front and back fluid compartments.

7. The apparatus as defined in claim 6 wherein the inlet is arranged to admit the second electrolyte solution into the back fluid compartment and the fluid outlet is arranged in fluid communication with the front fluid compartment in position to require the second electrolyte solution entering the back compartment through the inlet to flow around the free edge of the partition wall and through substantially the entire front compartment before passing through the outlet.

8. The apparatus as defined in claim 7 further comprising support means mounting the cathode within the bath with the membrane, the cathode, and the back wall extending in generally vertical planes and with the end edge walls extending in horizontal planes, and wherein the inlet and outlet are formed in the upper end edge wall.

9. The apparatus as defined in claim 8 wherein said inlet and said outlet each comprises a plurality of openings in the upper end edge wall, and conduit means connected to each inlet opening and connected to each outlet opening.

10. The apparatus as defined in claim 8 further comprising electrically-conductive means joined to said cathode means and extending through one wall of the chamber for supplying electrical current to the cathode.

11. The apparatus as defined in claim 10 wherein the membrane is supported by an open rectangular frame mounted in fluid-tight relation on the front wall of the closed boxlike chamber.

12. The apparatus as defined in claim 11 wherein the cathode is formed from an expanded metal plate having a regular pattern of openings formed therein, the openings permitting free passage of the second electrolyte solution flowing thereover.

13. The apparatus as defined in claim 12 wherein said end and side edge walls, said back wall, and a portion of said front wall are formed from a corrosive metal, said apparatus further comprising a coating of a rubber-like dielectric material covering the external surface of the corrosive metal walls to avoid contact of the corrosive metal with the first electrolyte solution.

14. The apparatus as defined in claim 4 wherein the cathode is formed from an expanded metal plate having a regular pattern of openings formed therein, the openings permitting free passage of the second electrolyte solution flowing thereover.

15. The apparatus as defined in claim 4 wherein said end and side edge walls, said back wall, and a portion of said front wall are formed from a corrosive metal, said apparatus further comprising a coating of a rubber-like dielectric material covering the external surface of the corrosive metal walls to avoid contact of the corrosive metal with the first electrolyte solution.

16. The apparatus as defined in claim 4 wherein the membrane is supported by an open rectangular frame mounted in fluid-tight relation on the front wall of the closed boxlike chamber.

17. The apparatus as defined in claim 7 wherein the cathode is formed from an expanded metal plate having a regular pattern of openings formed therein, the openings permitting free passage of the second electrolyte solution flowing thereover.

18. The apparatus as defined in claim 7 wherein said end and side edge walls, said back wall, and a portion of said front wall are formed from a corrosive metal, said apparatus further comprising a coating of a rubber-like dielectric material covering the external surface of the corrosive metal walls to avoid contact of the corrosive metal with the first electrolyte solution.

19. An apparatus for electrolytic treatment of an elongated strip of metal comprising, in combination, means for drawing the strip through a bath of a first electrolyte solution between a positively-charged anode submerged in the bath and a negatively-charged cathode, the cathode including metal plate means defining a generally rectangular, substantially flat cathode surface, a fluid-tight chamber enclosing the means defining the cathode surface, the fluid-tight chamber including a generally rectangular frame extending around the periphery of the cathode surface, the frame including a pair of generally parallel opposed side wall members and a pair of generally parallel opposed end wall members, and front and back wall panels extending in generally parallel relation one on each side of the metal plate means and cooperating with the frame members to enclose the cathode surface, the front wall panel including an ion-permeable membrane extending in closely-spaced relation to the cathode surface, mounting means supporting the fluid tight chamber within the first electrolyte solution with the cathode surface in generally parallel opposed relation to and spaced from the anode with the ion-permeable membrane extending between the anode and the cathode surfaces, and fluid inlet and outlet means in the compartment providing a fluid flow path through the chamber over the cathode surface enclosed therein and over the ion-permeable membrane whereby a second electrolyte solution may be circulated over the cathode surface and the membrane while the cathode is submerged in the first electrolyte solution.

20. The apparatus as defined in claim 19 further comprising a partition wall mounted within the fluid-tight chamber between the metal plate means and the back wall panel and extending generally parallel thereto between the side wall members from one end wall member, and terminating in a free edge disposed adjacent the other end wall member, the partition wall dividing the fluid-tight chamber into thin front and back fluid compartments.

21. The apparatus as defined in claim 20 wherein the inlet means is arranged to admit the second electrolyte solution into the back fluid compartment and the fluid outlet means is arranged in fluid communication with the front fluid compartment in position to require the second electrolyte solution entering the back compartment through the inlet to flow around the free edge of the partition wall and through substantially the entire front compartment before passing through the outlet.

22. The apparatus as defined in claim 21 wherein the mounting means supports the fluid-tight chamber within the first electrolyte solution with the membrane, the cathode, and the back wall panel extending in generally vertical planes and with the end wall members extending in horizontal planes, and wherein the inlet and outlet are formed in the upper end wall member.

23. The apparatus as defined in claim 19 further comprising electrically-conductive means joined to said metal plate means and extending through one wall of the chamber for supplying electrical current to the cathode surface.

24. The apparatus as defined in claim 23 wherein the metal plate is an expanded metal plate having a regular pattern of openings formed therein, the openings permitting free passage of the second electrolyte solution flowing thereover.

25. The apparatus as defined in claim 19 wherein said end and side wall members, said back wall panel, and a portion of said front wall panel are formed from a corrosive metal, said apparatus further comprising a coating of a rubberlike dielectric material covering the external surface of the corrosive metal to avoid contact with the first electrolyte solution.

26. The apparatus as defined in claim 25 wherein the membrane is supported by an open rectanglar frame mounted in fluid-tight relation on the front wall panel, the frame and membrane extending over and closing a rectangular opening in the corrosive metal portion of the front wall panel.

* * * * *